United States Patent [19]

Saunders et al.

[11] Patent Number: 4,763,600

[45] Date of Patent: Aug. 16, 1988

[54] APPARATUS FOR PERMANENTLY SETTING CREASES IN PANTS

[76] Inventors: Eugene M. Saunders, 4 Lake Forest Ct., Greensboro, N.C. 27408; Nicholas S. Hood, 4205 Belvoir Dr., Greensboro, N.C. 27406; John R. Sanko, 1205 S. 8th St., Altoona, Pa. 16602; Virgil J. Johnson, 504 Blend St., Bay City, Mich. 48706

[21] Appl. No.: 893,233

[22] Filed: Aug. 5, 1986

[51] Int. Cl.[4] ..... B05C 11/10; B05C 3/18; B05C 3/20

[52] U.S. Cl. ..... 118/684; 38/14; 118/408; 118/411

[58] Field of Search ..... 38/1 B, 14, 144; 118/408, 411, 684; 427/286

[56] References Cited

U.S. PATENT DOCUMENTS

| | | | |
|---|---|---|---|
| 3,713,567 | 1/1973 | Paris | 223/73 |
| 4,182,264 | 1/1980 | Gibson et al. | 118/306 |
| 4,607,589 | 8/1986 | Gibson | 38/14 X |

*Primary Examiner*—Evan K. Lawrence

*Attorney, Agent, or Firm*—Finnegan, Henderson, Farabow, Garrett & Dunner

[57] ABSTRACT

An apparatus for permanently setting pre-formed creases of a pair of pants comprises a stanchion member and a pair of spaced-apart substantially parallel support members extending substantially horizontally from the stanchion member. A substantially horizontal upper crease blade is fixed to each support member and has a lower crease blade pivoted thereto. The free ends of the crease blades extend away from the stanchion member and include applicator nozzles that are directed upward for the upper crease blades and downward for the lower crease blades. When a pair of pre-creased pants are slipped over the crease blades and the lower crease blades are pivoted downward, the pants are pulled taut at the hems between the pre-formed creases. As the pants are pulled off of the crease blades a pumping mechanism supplies a flowable, curable setting material such as silicone rubber to the applicator nozzles, which apply a coating of setting material to the inside surfaces of the pant legs along the creases. When the setting material cures, it hardens into the shape of the creases. A method using the apparatus, for permanently setting all four creases of a pair of right-side-out pants simultaneously also is disclosed.

7 Claims, 4 Drawing Sheets

APPARATUS FOR PERMANENTLY SETTING CREASES IN PANTS

BACKGROUND OF THE INVENTION

1. Field of the Invention

The present invention relates to an apparatus for permanently setting pre-formed creases in a pair of pants. In particular, the present invention relates to an apparatus for applying a flowable, curable setting material to the inside surface of the pants along the four creases simultaneously, without having to turn the pant legs inside out.

2. Description of the Related Art

Although permanently creased pants made of polyester and other synthetic fibers are well known in the art, no cost-efficient method of applying a permanent crease to pants made of natural fibers and other non-permanent press materials has been demonstrated.

One method that has met with limited commercial success provides a permanent crease to a pant leg by turning a pair of pants inside-out after they have been pressed by conventional means and applying a flowable, curable setting material such as silicone rubber to the inside surface of the pant legs along the creases one crease at a time. The setting material is permitted to cure and maintains the shape of the creases after washing or drycleaning. An apparatus for imparting a crease in accordance with the above-described method is disclosed in U.S. Pat. No. 4,182,264, the disclosure of which is incorporated herein by reference to the extent necessary to achieve a thorough understanding of the background of the invention.

Such an apparatus and method are very time-consuming and labor-intensive. They require turning the pants inside out, carefully aligning each inside-out crease with a V- or channel-shaped trough, manually applying the setting material to each inside out crease with an application tool, and turning the pants right side out after application of the setting material.

The present invention is intended to provide an apparatus for permanently setting the creases of a pair of pants without requiring the pants to be turned inside out.

The present invention also is intended to provide an apparatus for permanently setting the creases of a pair of pants in a time-efficient manner that will minimize the manufacturing costs of achieving permanent creases.

In addition, the present invention is intended to provide an apparatus for permanently setting all four creases of a pair of pants simultaneously without requiring the pants to be turned inside out.

Additional advantages of the present invention will be set forth in part in the description that follows and in part will be obvious from that description or can be learned from practice of the invention. The advantages of the invention can be realized and obtained by the apparatus particularly pointed out in the appended claims.

SUMMARY OF THE INVENTION

The present invention overcomes the problems of the prior art apparatus for permanently setting creases in pants by providing an apparatus that supports a pair of pants from the inside surface of the pant legs along pre-formed pant-leg creases. The pants are slidably removable from the support mechanism, and as the pants are removed, applicator nozzles apply a coating of a flowable, curable setting material to the inside surfaces of the pant legs along each crease simultaneously.

To overcome the problems of the prior art and in accordance with the purpose of the invention, as embodied and broadly described herein, the apparatus of this invention for permanently setting a pre-formed crease in a pant leg comprises means for supporting the pant leg right side out along the inside surface of the crease, the pant leg being slidably removable from the supporting means in a direction parallel to the crease, and means for applying a coating of a flowable, curable setting material along the inside surface of the crease as the pant leg is being slidably removed from the supporting means.

Broadly, the present invention further provides an apparatus for permanently setting creases in a pair of pants and comprises: a stanchion member; a pair of spaced-apart substantially parallel support members each having one end fixed to the stanchion member and a free end extending substantially horizontally from the stanchion member; a pair of substantially horizontal first crease blades each aligned with and positioned above an individual one of the support members and fixed to the individual support member, each of the first crease blades having a free end extending away from the stanchion member, and the free end of each of the first crease blades including an upper applicator nozzle directed substantially upward; a pair of second crease blades each aligned with an individual one of the support members, each of the second crease blades having one end pivotally connected to the individual support member and a free end extending away from the stanchion member, and the free end of each of the second crease blades including a lower applicator nozzle directed substantially downward; means for pivoting the free ends of the second crease blades away from the free ends of the first crease blades; and means for supplying a flowable, curable setting material to the upper and lower applicator nozzles.

Preferably, the setting material is a silicone rubber compound, and the creasing material supplying means includes means for containing a supply of the setting material, conduit means for conveying the setting material from the containing means to the upper and lower applicator nozzles, means for pumping the setting material from the containing means to the applicator nozzles through the conduit means, and valve means for selectively permitting and blocking flow of the setting material to the applicator nozzles.

The method used with the apparatus of this invention for permanently setting pre-formed creases of a pair of pants having first and second creases extending from the hem to the crotch portion of each pant leg comprises the steps of: supporting the pants on a pair of first crease blades so that the first crease of each pant leg is aligned with and rests on an individual first crease blade; pulling each of the pant legs taut between the first and second creases to permit removal of the pants from the first crease blades while maintaining contact between the first creases and the first crease blades; pumping a flowable, curable setting material to a predetermined point on each first crease blade where the first crease blade is in contact with the first crease; sliding the pants off of the first crease blades to apply the setting material to the inside surface of each of the pant legs along the first crease as the first crease passes the predetermined point of the first crease blade; and curing the setting material.

Preferably, the pulling step includes abutting a second crease blade against the inside surface of the second crease of each pant leg adjacent the hem, and the pumping step includes pumping the setting material to a predetermined point on each of the second crease blades where the second crease blade is in contact with the second crease.

The accompanying drawings, which are incorporated in and which constitute a part of this specification, illustrate one embodiment of the invention and, together with the description, explain the principles of the invention.

DESCRIPTION OF THE PREFERRED EMBODIMENT

Reference now will be made in detail to a presently preferred embodiment of the invention, an example of which is illustrated in the accompanying drawings.

Figure 1:
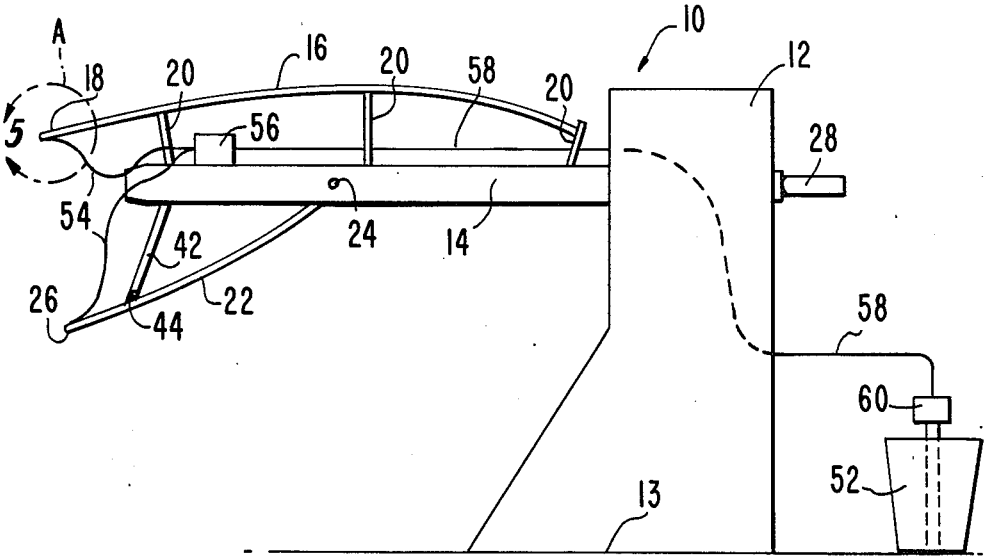
FIG. 1 is a side elevational view of the apparatus of the present invention.
Figure 2:
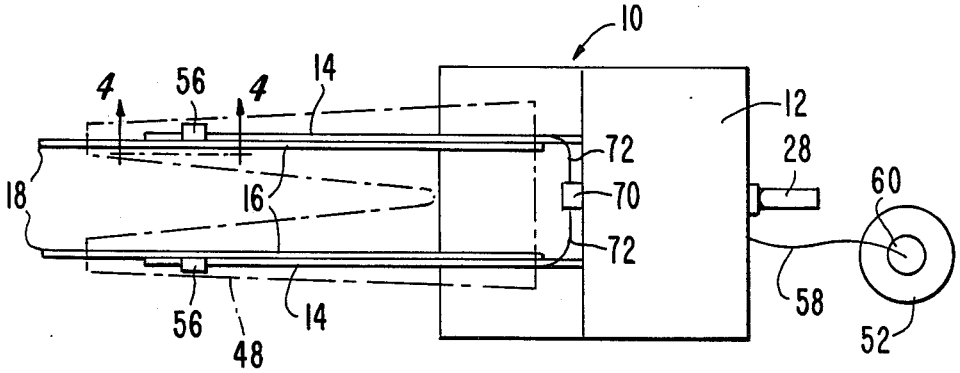
FIG. 2 is a plan view of the apparatus shown in FIG. 1 showing how a pair of pants is mounted on the apparatus.

FIGS. 1 and 2 show the apparatus of the present invention, designated generally by reference numeral 10. Apparatus 10 includes stanchion 12 extending vertically upward from a base portion 13 and a pair of spaced-apart substantially parallel support members 14 extending substantially horizontally from stanchion member 12.

Apparatus 10 includes means for supporting each pant leg of a pair of pants along the inside surfaces of a pair of pre-formed creases in each pant leg. As embodied herein, the supporting means includes a pair of fixed, substantially horizontal upper crease blades 16, each of which is aligned with and positioned above one of support members 14. Each upper crease blade 16 includes free end 18 extending away from stanchion member 12. Upper crease blades 16 are connected to their respective support members 14 by crease blade connectors 20. Preferably, upper crease blades 16 have a small-radius top edge to facilitate the alignment of the pre-formed creases of the pant legs with the upper crease blades.

Apparatus 10 includes means for pulling each pant leg taut between the pant leg's pair of creases. As embodied herein, the pulling means includes a pair of lower crease blades 22, each of which is pivotally connected to an individual support member 14 by pin 24. Free end 26 of each lower crease blade 22 extends in a direction away from stanchion member 12. The bottom edges of crease blades 22 preferably are of a small radius.

Figure 3:
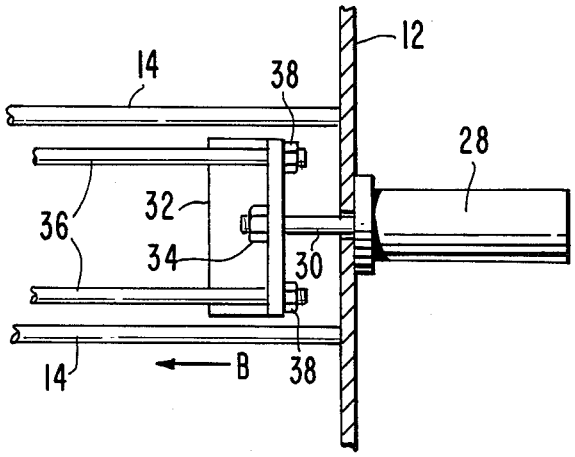
FIG. 3 is a cross-sectional plan view of a portion of a mechanism for pivoting the lower crease blades of the present invention.

Apparatus 10 includes means for pivoting the free ends 26 of lower crease blades 22 away from free ends 18 of upper crease blades 16. As embodied herein and as shown in FIGS. 3, the pivoting means includes an air cylinder 28 mounted on the outside of stanchion 12 and having a piston rod 30 extending into the interior portion of stanchion 12. The free end of piston rod 30 is threaded and is fixed to L-shaped bracket 32 by nut 34.

Figure 4:
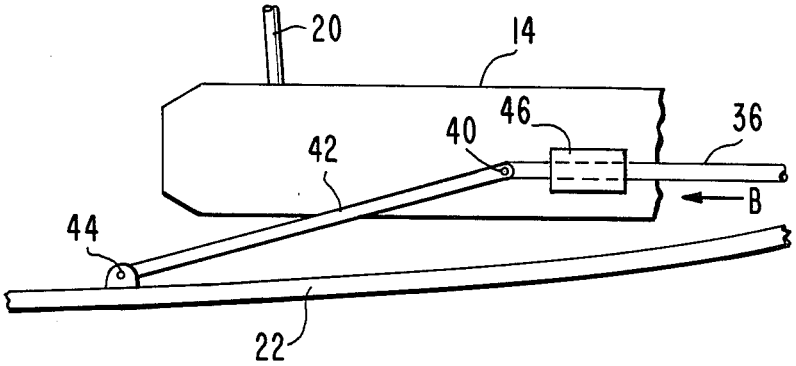
FIG. 4 is a side elevational view of a portion of the apparatus of the present invention taken along line 4—4 of FIG. 2.

The pivoting means includes linkage means connecting air cylinder 28 to each of lower crease blades 22. As embodied herein, the linkage means includes rods 36, which extend alongside support members 14 and are attached to bracket 32 by nuts 38. As shown in FIG. 4, the end of each rod 36 extending away from stanchion 12 is pivotally connected by pin 40 to link 42, which also is pivotally connected to a lower crease blade 22 by pin 44. Each rod 36 is slidably supported by guide 46 attached to support member 14 so that rod 36 moves along its axis when air cylinder 28 is actuated.

When air cylinder 28 extends piston rod 30 to the left as seen in FIG. 3, rods 36 slide axially in the direction of arrow B through guides 46 toward the free ends of support members 14. Because of the connection of rods 36 to lower crease blades 22 via links 42, the movement of rods 36 in the direction of arrow B forces lower crease blades 22 to pivot downwardly and pull taut on the hems of the pant legs supported on upper crease blades 16. Lower crease blade 22 is shown in its downward or extended position in FIG. 1 and in its upward or retracted position in FIG. 4. The pivoting of lower crease blades 22 can be adjusted for different styles and sizes of pants by providing an adjustable stop (not shown) that limits the travel of piston rod 30.

To mount a pair of pants (designated by reference numeral 48 in FIG. 2) on apparatus 10, air cylinder 28 is retracted to pivot free end 26 of lower crease blade 22 toward free end 18 of upper crease blade 16. Retracting air cylinder 28 facilitates slipping the pant legs of pants 48 over their corresponding upper crease blades 16 and lower crease blades 22. After the operator mounts the pants on apparatus 10, an actuator switch such as a foot pedal (not shown) is pressed to permit the flow of compressed air to cylinder 28 and extend cylinder 28 to pivot free end 26 away from free end 18 and to pull each pant leg taut at its hem between its pair of creases.

Apparatus 10 also includes means for applying a coating of a flowable, curable setting material along the inside surface of each crease of the pant legs simultaneously as the pant legs are slidably removed from the crease blades in a direction toward free ends 18 and 26. As embodied herein, the setting material applying means includes applicator nozzles 50, one of which is located at the free end of each crease blade 16, 22. Applicator nozzle 50 in free end 18 of upper crease blade 16 is directed substantially upward (see FIG. 5), and applicator nozzle 50 in free end 26 of lower crease blade 22 is directed substantially downward. Thus, applicator nozzles 50 open up upon the inner surface of the pant legs along the creases as the pant legs are removed from the apparatus.

Applicator nozzles 50 are in flow communication with means for containing a supply of the flowable, curable setting material. As embodied herein, the containing means includes drum 52. Applicator nozzles 50 are connected to drum 52 via feed conduits 54, control valves 56, supply conduit 58, and pump 60. Preferably, pump 60 is a conventional pail pump having a member extending to the bottom portion of drum 52.

Figure 5:
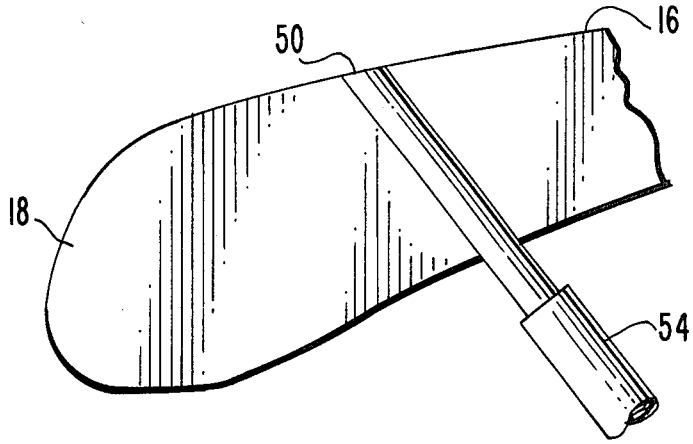
FIG. 5 is an enlarged view of the portion of the apparatus enclosed by circle A of FIG. 1.

In the preferred embodiment shown in FIG. 5, each applicator nozzle 50 comprises a tube inserted into a feed conduit 54 and passing through upper crease blade 16 at free end 18 (or through lower crease blade 22 at free end 26). As embodied in FIG. 5 the connection between applicator nozzle 50 and upper crease blade 16 is provided by removing free end 18 from crease blade 16, attaching nozzle 50 to the severed end of crease blade 16, and attaching free end 18 to nozzle 50. Preferably, crease blade 16, free end 18, and applicator nozzle 50 are comprised of stainless steel and are attached by welding. Nozzles 50 are attached to lower crease blades 22 in the same manner.

The setting material preferably is an oxime type, an acetic acid type, or a multiple-component self-catalyzing type silicone rubber compound that partially cures to a non-tacky texture in approximately 20 minutes at room temperature and completely cures in approximately 8 hours at room temperature and normal relative humidity. More preferably, the setting material is an oxime type silicone rubber compound.

Conduits 54 preferably are lined with PTFE sold under the trademark Teflon®, a registered trademark of E. I. du Pont de Nemours & Co., to reduce the frictional resistence to the flow of the setting material and to restrict the permeation of moisture through conduits 54 into the setting material. The Teflon® tubing also minimizes adverse reactions between the conduit material and the setting material that might discolor or interfere with the curing of the setting material. To further reduce such reactions, the pail pump's pumping mechanism, supply conduit 58, crease blades 16 and 22, and applicator nozzles 50 preferably are constructed of stainless steel.

The method of operation of apparatus 10 now will be described in detail. The apparatus of this invention can be operated manually or mechanically, for example, by a robot.

Preferably, prior to the mounting of pants 48 on apparatus 10, pants 48 are pressed by conventional methods to form a pair of substantially parallel creases in each pant leg extending from approximately the crotch portion of the pant leg to the hem of the pant leg. Pants 48 then are manually slipped over upper crease blades 16 and lower crease blades 22. Air cylinder 28 preferably is in its retracted position so that free end 26 of lower crease blade 22 is pivoted toward free end 18 of upper crease blade 16 as the pants are being mounted. The seat portion of pants 48 preferably is directed downward so that the front creases of the pant legs can be aligned with upper crease blades 16. The seat portion, however, can be directed upward as well.

After the front creases are aligned with the underlying top crease blade 16, air cylinder 28 is actuated to assume its extended position, and free end 26 of each lower crease blade 22 is pivoted away from free end 18 of its corresponding upper crease blade 16. Because each upper blade 16 is aligned with the front crease of its corresponding pant leg, free end 26 of lower crease blade 22 will be aligned with the rear crease of the respective pant leg.

The operator than grasps each pant leg at its hem and simultaneously activates a second actuating device (not shown) that opens control valves 56 and permits the setting material pumped by pump 60 to flow through feed conduits 54 to and out of applicator nozzles 50 at a prescribed rate. The setting material coats a portion of the inside surface of the pant legs along the creases as the pant legs are being removed from apparatus 10.

Figure 7:
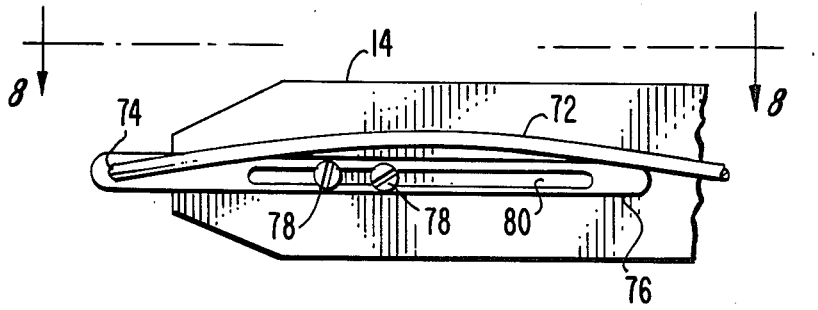
FIG. 7 is a side elevational view of a portion of the crotch detecting means of the present invention.
Figure 8:
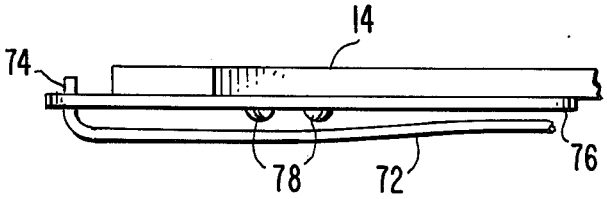
FIG. 8 is a plan view taken along lines 8—8 of FIG. 7.

Preferably, apparatus 10 also includes automatic stop means for causing the control valves 56 to close and block the flow of the setting material to the applicator nozzles when the crotch portion of the pants being removed from the apparatus is at a predetermined distance from applicator nozzles 50. As embodied herein, the automatic stop means includes a detecting unit 70 mounted on stachion 12. A pair of optical fiber cables 72 are connected to detecting unit 70. Each optical cable extends along the outside face of a support member 14 towards its free end. As shown in FIGS. 7 and 8, the ends 74 of optical fiber cables 72 are turned toward each other to provide a complete optical circuit. Each end 74 is mounted on its respective supporting member 14 by adjusting bracket 76. Bracket 76 connects to supporting member 14 with a pair of screws 78, which pass through elongated slot 80 of bracket 76. Each end 74 of optical cables 72 are separated from applicator nozzles 50 in the direction toward stanchion member 12 by the above-mentioned predetermined distance.

Detecting unit 70 generates an optical signal through one of optical fiber cables 72. As long as the crotch portion of pants 48 is toward stanchion member 12 with respect to the position of ends 74, the inseam portion of the pant legs prevents the optical signal from reaching the other cable 72 and being detected by detecting unit 70. As soon as the crotch portion of pants 48 passes the position of ends 74, however, detecting unit 70 is able to detect the returning optical signal and a control circuit (not shown) automatically closes control valves 56 to block the flow of setting material to applicator nozzles 50. The position of ends 74 can be adjusted by loosening screws 78 and sliding brackets 76 relative to support members 14 along slots 80 to permit variation of the predetermined distance with different pant styles and sizes.

Figure 6:
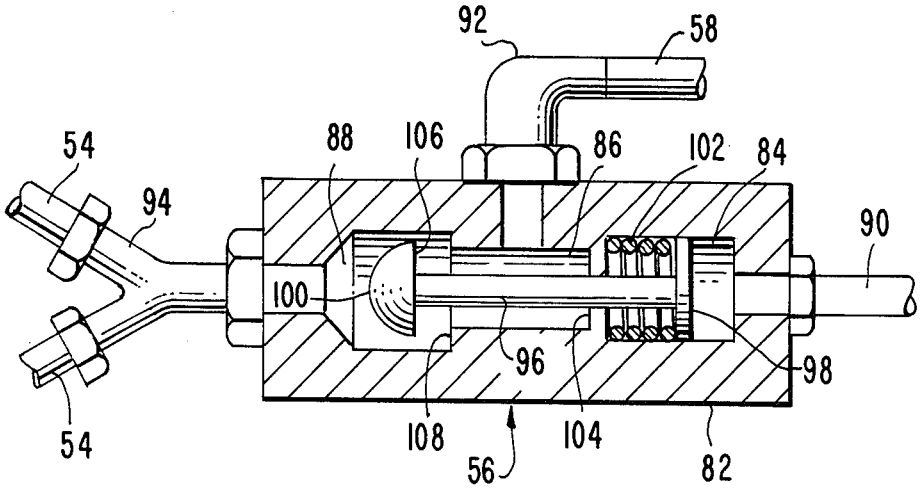
FIG. 6 is a sectional view of the control valve of the present invention.

Although control valves 56 are positioned upstream of applicator nozzles 50 by some distance, so that a substantial amount of setting material remains in feed conduits 54 after control valves 56 are closed, control valves 56 operate to prevent the setting material in feed conduits 54 from flowing out of applicator nozzles 50 when control valves 56 are closed. As shown in FIG. 6, valve 56 includes a valve body 82 having an air chamber 84, a supply chamber 86, and a delivery chamber 88. An air conduit 90 is connected to air chamber 84. Supply conduit 58 is connected to supply chamber 86 by L-shaped fitting 92. Two feed conduits 54 are connected to delivery chamber 88 by Y-shaped fitting 94. Valve 56 also includes plunger 96, which has a piston portion 98 at one end and a sealing head 100 at the other end. Coil spring 102 is positioned between piston portion 98 and land 104 (which separates air chamber 84 from supply chamber 86) and urges plunger 96 to the right in FIG. 6.

When the air pressure supplied from a pressure control mechanism (not shown) to air conduit 90 and acting on piston portion 98 overcomes the resistance of spring 102, plunger 96 moves to the left as seen in FIG. 6, and setting material flows from supply conduit 58, through supply chamber 86, around sealing head 100, through delivery chamber 88, and out feed conduits 54. FIG. 6 shows valve 56 in this open position. When the air pressure is cut off to stop the flow of setting material to feed conduits 54, plunger 96 moves to the right in FIG. 6 under the force of spring 102, and the underside surface 106 of sealing head 100 seats on shoulder 108 to stop the flow of setting material to feed conduits 54. The movement of sealing head 100 away from feed conduits 54 effectively creates a partial vacuum that prevents setting material from oozing out of applicator nozzles 50 when valve 56 is closed.

The inside diameter of applicator nozzles 50 can range from 0.25 mm to 5.0 mm but preferably is approximately 1.6 mm. The pumping flow rate of pump 60 is approximately 25–500 g/min. We have found that a deposition rate (using silicone rubber) varying from about 0.5 gram per meter of crease length to about 20 grams per meter of crease length provides reliable crease permanence for a practical range of fabric weights. At such a setting material supply rate, the operator removing the pants from the apparatus at a speed of about 25–500 mm/sec can provide the pants with the proper amount of setting material. Preferably, the setting material deposition rate is 1.5–2.5 grams per meter and the pants removal speed is 200–300 mm/sec.

After the pants are removed from apparatus 10, the setting material is allowed to cure. The setting material applied to the creases infiltrates the fabric of the pant legs and assumes the shape of the fabric at the creases. Upon curing, the setting material solidifies in the shape of the creases and permanently sets the the creases. As stated above, when a silicone rubber compound is used as the setting material and allowed to cure, the creases retain their shape after washing and/or drycleaning throughout the useful life of the garment.

It will be apparent to those skilled in the art that modifications and variations can be made in the apparatus of this invention without departing from the scope of the invention. For example, creasing materials other than silicone rubber can be used by the apparatus described. In addition, the apparatus could include a single support member, upper crease blade, and lower crease blade for permanently setting the creases of a pair of pants one pant leg at a time. Setting material can be applied one crease at a time. The invention in its broader aspects is, therefore, not limited to the specific details and illustrated examples shown and described. Accordingly, it is intended that the present invention cover such modifications and variations, provided that they fall within the scope of the appended claims and their equivalents.

What is claimed is:

1. An apparatus for permanently setting pre-formed creases of a pair of pants, comprising:

a. a stanchion member;

b. a pair of spaced-apart substantially parallel support members each having one end fixed to said stanchion member and a free end extending substantially horizontally from said stanchion member;

c. a pair of substantially horizontal first crease blades each aligned with and positioned above an individual one of said support members and fixed to said individual support member, each of said first crease blades having a free end extending away from said stanchion member, and said free end of each of said first crease blades including an upper applicator nozzle directed substantially upward;

d. a pair of second crease blades each aligned with an individual one of said support members, each of said second crease blades having one end pivotally connected to said individual support member and a free end extending away from said stanchion member, and said free end of each of said second crease blades including a lower applicator nozzle directed substantially downward;

e. means for pivoting said free ends of said second crease blades away from said free ends of said first crease blades; and f. means for supplying a flowable, curable setting material to said upper and lower applicator nozzles.

2. The apparatus of claim 1, wherein said pivoting means includes an air cylinder mounted on said stanchion and linkage means connecting said air cylinder to each of said second crease blades.

3. The apparatus of claim 1, wherein said setting material supplying means includes means for containing a supply of said setting material, conduit means for conveying said setting material from said containing means to said upper and lower applicator nozzles, means for pumping said setting material from said containing means to said applicator nozzles through said conduit means, and valve means for selectively permitting and blocking flow of said setting material to said applicator nozzles.

4. An apparatus for permanently setting pre-formed creases of a pair of pants, comprising:

a. a stanchion member;

b. a pair of spaced-apart substantially parallel support members each having one end fixed to said stanchion member and a free end extending substantially horizontally from said stanchion member;

c. a pair of substantially horizontal first crease blades each aligned with and positioned above an individual one of said support members and fixed to said individual support member, each of said first crease blades having a free end extending away from said stanchion member, and said free end of each of said first crease blades including an upper applicator nozzle directed substantially upward;

d. a pair of second crease blades each aligned with an individual one of said support members, each of said second crease blades having one end pivotally connected to said individual support member and a free end extending away from said stanchion member, and said free end of each of said second crease blades including a lower applicator nozzle directed substantially downward;

e. means for pivoting said free ends of said second crease blades away from said free ends of said first crease blades;

f. means for containing a supply of flowable, curable setting material;

g. conduit means for conveying said setting material from said containing means to said applicator nozzles;

h. means for pumping said setting material from said containing means to said applicator nozzles;

i. valve means for selectively permitting and blocking the flow of said creasing material to said applicator nozzles;

j. wherein said pants are mountable over said pairs of crease blades, each leg of said pants being mounted over said upper and lower crease blades corresponding to an individual support member, the crotch of said pants being positioned adjacent said stanchion portion and the hems of said pant legs extending toward said free ends of said crease blades, said creases of said pants being aligned with said crease blades so that when said pants are slidably removed from said crease blades in a direction away from said stanchion member, said setting material flowing from said applicator nozzles coats the inside surface of said pants along said creases.

5. The apparatus of claim 4, further comprising automatic stop means for causing said valve means to block the flow of said setting material to said application nozzles when said crotch portion of said pants being removed from said crease blades is a predetermined distance from said applicator nozzles.

6. The apparatus of claim 5, wherein said automatic stop means includes a light source mounted on one of said support members and a photodetector device mounted on the other of said support members, said light source and said photodetector device being separated from said applicator nozzles by said predetermined distance toward said stanchion member, said photodetector device detecting said light source after said crotch portion has passed therebetween.

7. The apparatus of claim 5, wherein said predetermined distance is adjustable.

* * * * *